US008656527B2

(12) United States Patent
Yang

(10) Patent No.: US 8,656,527 B2
(45) Date of Patent: Feb. 25, 2014

(54) MULTIFUNCTIONAL FURNITURE

(75) Inventor: Lei Yang, City of Industry, CA (US)

(73) Assignee: Furniture of America, Inc., City of Industry, CA (US)

( * ) Notice: Subject to any disclaimer, the term of this patent is extended or adjusted under 35 U.S.C. 154(b) by 47 days.

(21) Appl. No.: 13/134,823

(22) Filed: Jun. 16, 2011

(65) Prior Publication Data

US 2012/0317712 A1 Dec. 20, 2012

(51) Int. Cl.

| | |
|---|---|
| ***A47C 17/04*** | (2006.01) |
| ***A47B 83/00*** | (2006.01) |
| ***A47C 17/00*** | (2006.01) |

(52) U.S. Cl.

USPC ..... 5/38; 5/2.1; 5/12.1; 5/37.1

(58) Field of Classification Search

USPC ..... 5/2.1, 12.1, 37.1, 38, 285, 312, 315.1; 297/354.1

See application file for complete search history.

(56) References Cited

U.S. PATENT DOCUMENTS

| | | | | | |
|---|---|---|---|---|---|
| 65,640 | A | * | 6/1867 | Buehler | 5/42 |
| 938,674 | A | * | 11/1909 | Locklin | 5/38 |
| 1,297,059 | A | * | 3/1919 | Barnes | 297/354.1 |
| 1,306,268 | A | * | 6/1919 | McArdle | 297/363 |
| 1,456,574 | A | * | 5/1923 | Roberts et al. | 16/366 |
| 1,734,943 | A | * | 11/1929 | Farrell | 297/370 |
| 1,979,568 | A | * | 11/1934 | Bales et al. | 108/125 |
| 2,085,719 | A | * | 6/1937 | Martin | 5/37.1 |
| 2,108,774 | A | * | 2/1938 | Lipert | 403/170 |
| 2,179,152 | A | * | 11/1939 | Johnson | 5/38 |
| 2,214,078 | A | * | 9/1940 | Feldman | 5/37.1 |
| 2,240,204 | A | * | 4/1941 | Bell | 297/105 |
| 2,356,077 | A | * | 8/1944 | Mount | 5/38 |
| 2,438,127 | A | * | 3/1948 | Poskin | 5/38 |
| 2,558,915 | A | * | 7/1951 | Sheffer | 403/65 |
| 2,700,164 | A | * | 1/1955 | Abajian | 5/38 |
| 2,971,803 | A | * | 2/1961 | Wallin | 16/326 |
| 3,327,328 | A | * | 6/1967 | Slivoski | 5/661 |
| 3,329,977 | A | * | 7/1967 | Heller | 5/38 |
| 3,861,329 | A | * | 1/1975 | Kitchen, Sr. | 108/125 |
| 4,221,428 | A | * | 9/1980 | Bowman et al. | 297/110 |
| 5,103,510 | A | * | 4/1992 | Thurow | 5/37.1 |
| 5,315,722 | A | * | 5/1994 | Djie | 5/37.1 |

(Continued)

FOREIGN PATENT DOCUMENTS

| | | | | |
|---|---|---|---|---|
| WO | WO 3068020 | A1 * | 8/2003 | A47B 3/08 |

*Primary Examiner* — William Kelleher
*Assistant Examiner* — Eric Kurilla
(74) *Attorney, Agent, or Firm* — Raymond Y. Chan; David and Raymond Patent Firm

(57) ABSTRACT

A multifunctional furniture includes a stationary seat frame, a supporting frame, a back frame pivotally connected to the stationary seat frame to move between a sitting mode and a bedding mode, and a leg frame arrangement, which is provided underneath the stationary seat frame, the back frame and the supporting frame. When the back frame is in the sitting mode, the back frame is pivotally extended from the leg frame arrangement to form a predetermined angle of inclination with respect to the stationary seat frame while the leg frame arrangement is arranged to support the stationary seat frame, wherein when the back frame is in the bedding mode, the back frame is pivotally moved to align with the seat frame to form a sleeping area, while the leg frame arrangement is operated to provide extensive support to both the back frame, the stationary seat frame and the supporting frame.

4 Claims, 6 Drawing Sheets

(56) References Cited

U.S. PATENT DOCUMENTS

| | | | | |
|---|---|---|---|---|
| 5,345,626 | A * | 9/1994 | Newton | 5/37.1 |
| 5,722,101 | A * | 3/1998 | Grigoriev | 5/37.1 |
| 6,427,261 | B1 * | 8/2002 | Chadbourn | 5/18.1 |
| 6,738,998 | B1 * | 5/2004 | Aubrey et al. | 5/37.1 |
| 7,249,563 | B2 * | 7/2007 | Chen et al. | 108/129 |
| 2003/0140422 | A1 * | 7/2003 | Sama | 5/658 |
| 2004/0158921 | A1 * | 8/2004 | Pine | 5/38 |
| 2011/0016626 | A1 * | 1/2011 | Kanthasamy | 5/37.1 |

* cited by examiner

MULTIFUNCTIONAL FURNITURE

BACKGROUND OF THE PRESENT INVENTION

1. Field of Invention

The present invention relates to multifunctional furniture, and more particularly to a multifunctional furniture article comprising a stationary seat frame, a back frame, and a leg frame arrangement which is capable of providing extensive support to the stationary seat frame and the back frame when they are selectively used in a sitting mode and a bedding mode.

2. Description of Related Arts

Referring to FIG. 1A and FIG. 1B of the drawings, a conventional multifunction furniture article, such as a sofa bed, usually comprises a stationary seat frame 10P, a back frame 20P, a supporting frame 30P, and a plurality of legs 40P provided underneath the stationary seat frame 10P and the supporting frame 30P. As shown in FIG. 1A of the drawings, when the furniture article is used as a sofa, the back frame 20P is pivotally and upwardly extended from the stationary seat frame 10P to form a predetermined angle of inclination with respect to the stationary seat frame 10P, while the supporting frame 30P is rearwardly extended from the stationary seat frame 10P. Note that the legs 40P are spacedly provided underneath the stationary seat frame 10P and the supporting frame 30P for providing support to the sofa bed as a whole.

As shown in FIG. 1B of the drawings, when the furniture article is used as a bed, the back frame 20P is pivotally and downwardly moved to align with the stationary seat frame 10P to rest on the supporting frame 30P. At this position, both the stationary seat frame 10P and the back frame 20P are supported by the legs 40P.

There are several disadvantages in associated with this conventional multifunctional furniture article. First, because the sofa bed is intended to be selectively used as a sofa or a bed, when it is used as a bed, the supporting frame 30P is primarily used for supporting the back frame 20P when it is pivotally moved to align with the seat frame 10P. As a result, there exists a tension between the size of the supporting frame 30P and the supporting strength needed for providing adequate support to the back frame 20P when the furniture is used as a bed. When the size of the supporting frame 30P is large, although it provides fairly good support to the back frame 20P, it significantly affect the aesthetic appearance of the entire furniture, and prohibits the sofa from being positioned next to a wall surface, as the supporting frame 30P must be rearwardly extended from the seat frame 10P. This severely limits widespread application of the conventional sofa bed. Moreover, when the size of the supporting frame 30P is too large, a rear edge 31P of the supporting frame 30P may bias against a wall surface when the furniture is used as a sofa. The rear edge 31P may be sharp enough to cause peeling of paint or otherwise cause damage to the wall surface.

On the other hand, when the size of the supporting frame 30P is too small, although it does not significant affect the aesthetic appearance of the entire furniture, it does not provide adequate support to the back frame 20P either. The result is that the sofa bed may break down very easily, especially when the person sleeping thereon is very heavy.

Second, there exists one type of sofa beds which has a sliding seat frame so that when a user needs to use it as a bed, the seat frame may be slid frontwardly and the back frame is pivotally moved to align with the seat frame. The problem with this type of conventional sofa bed is that the frame is complicated in structure. Moreover, almost all of these frames are made of metallic material and the cushion is put on top of the bed frame, they do not generally have very good aesthetic appearance. Furthermore, anyone seeing this type of sofa beds will notice that the bed frame and the cushion are two separate components, yet it is very difficult to make the cushion and the frame become one integral body because of the existence of the sliding seat frame.

SUMMARY OF THE PRESENT INVENTION

The invention is advantageous in that it provides a multifunctional furniture comprising a stationary seat frame, a back frame, and a leg frame arrangement which is capable of providing extensive support to the stationary seat frame and the back frame when they are selectively used in a sitting mode and a bedding mode.

Another advantage of the invention is to provide a multifunctional furniture comprising a leg frame arrangement which does not require sliding of the seat frame when the furniture changes between the sitting mode and the bedding mode, and provide equally good support in both modes of operation.

Another advantage of the invention is to provide a multifunctional furniture comprising a leg frame arrangement, wherein the furniture does not involve complicated mechanical structure for switching between the sitting mode and the bedding mode, so that the manufacturing cost of the present invention can be kept to the minimum.

Another advantage of the invention is to provide a multifunctional furniture comprising a leg frame arrangement, wherein the size of the supporting frame can be minimized without jeopardizing the supporting strength of the leg arrangement.

Additional advantages and features of the invention will become apparent from the description which follows, and may be realized by means of the instrumentalities and combinations particular point out in the appended claims.

According to the present invention, the foregoing and other objects and advantages are attained by providing a multifunctional furniture, comprising:

a stationary seat frame;

a supporting frame rearwardly extended from the stationary seat frame;

a back frame pivotally connected to the stationary seat frame to move between a sitting mode and a bedding mode; and a leg frame arrangement provided underneath the stationary seat frame, the back frame and the supporting frame, in such a manner that when the back frame is in the sitting mode, the back frame is pivotally extended from the leg frame arrangement to form a predetermined angle of inclination with respect to the stationary seat frame while the leg frame arrangement is arranged to support the stationary seat frame, wherein when the back frame is in the bedding mode, the back frame is pivotally moved to align with the seat frame to form a sleeping area, while the leg frame arrangement is operated to provide extensive support to both the back frame, the stationary seat frame and the supporting frame.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
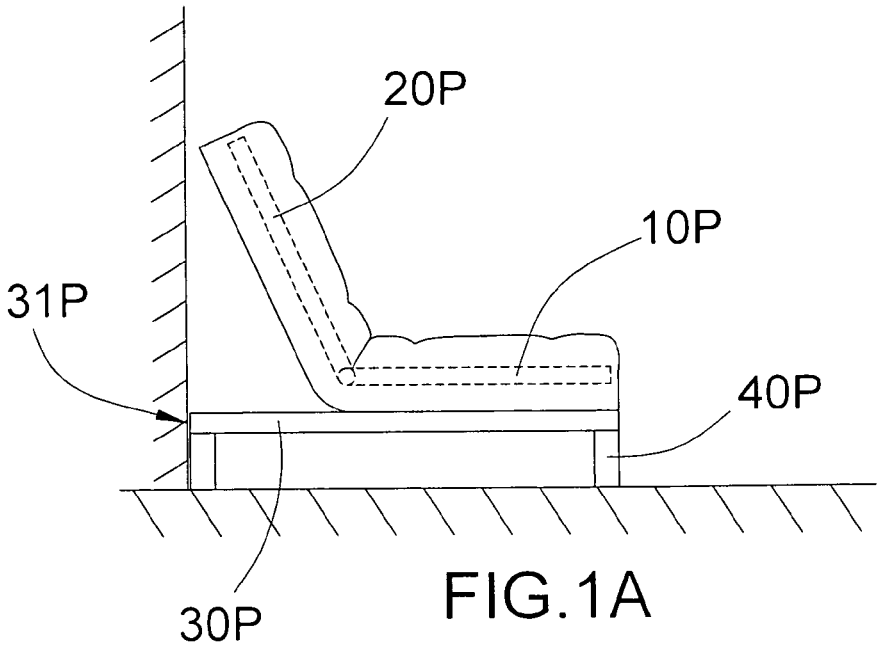
FIG.1A PRIOR ART
FIG. 1A and FIG. 1B are schematic diagrams of a conventional furniture article.
Figure 1B:
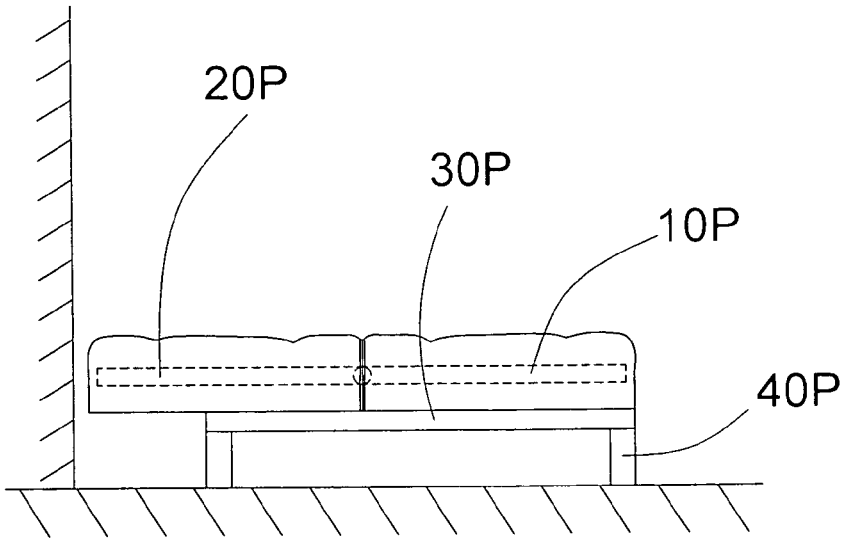
FIG.1B PRIOR ART
Figure 2:
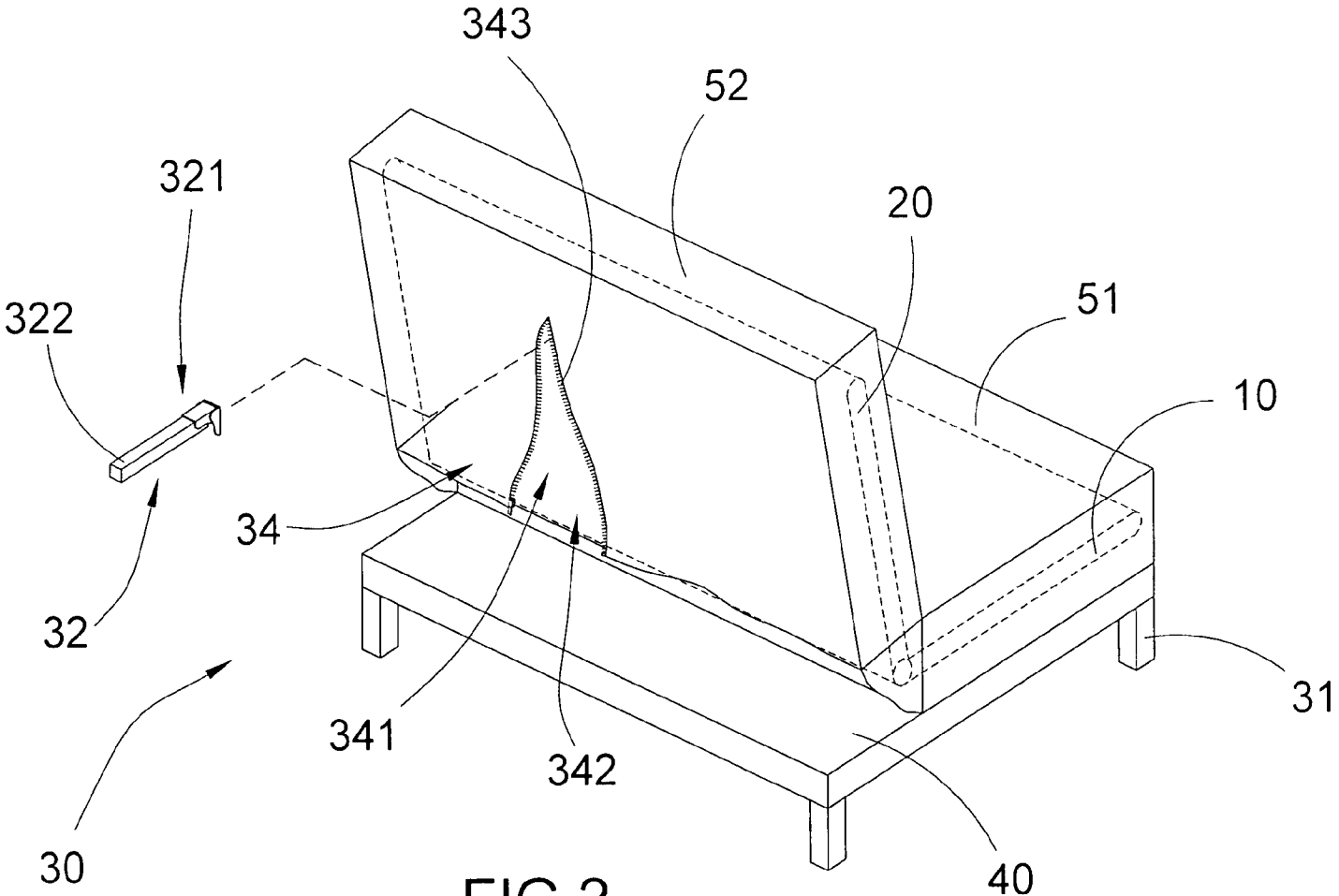
FIG. 2 is a perspective view of a multifunctional furniture according to a preferred embodiment of the present invention.
Figure 3:
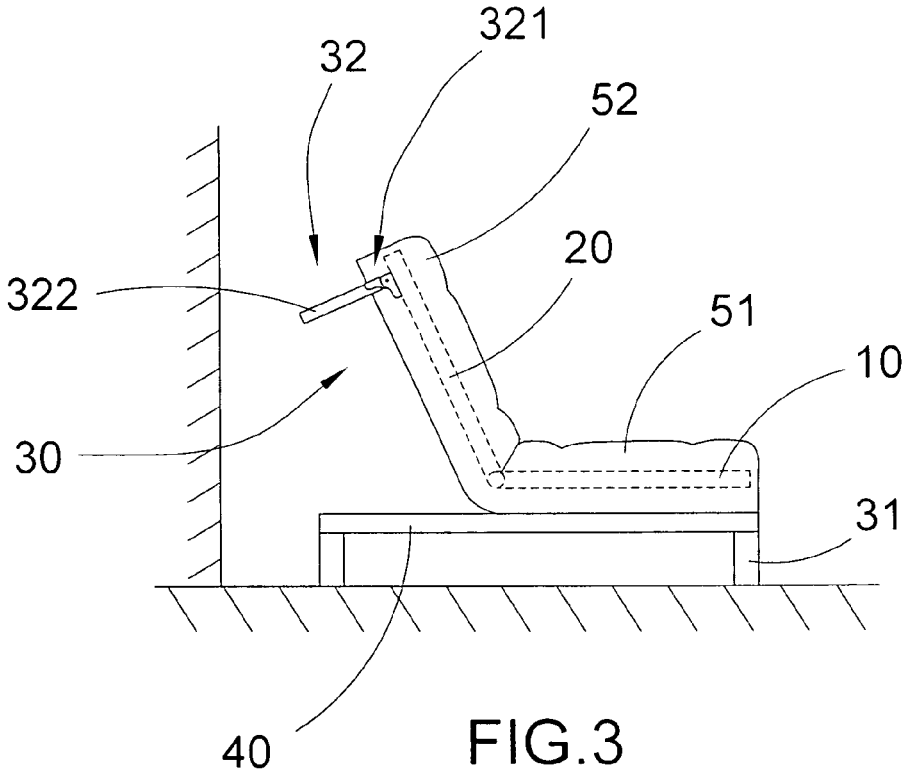
FIG. 3 is a side view of the multifunctional furniture according to the above preferred embodiment of the present invention.

Referring to FIG. 2 to FIG. 4, FIG. 5A to FIG. 5B and FIG. 6A to FIG. 6B of the drawings, a multifunctional furniture, such as a sofa bed, according to a preferred embodiment of the present invention is illustrated, in which the multifunctional furniture comprises a stationary seat frame 10, a back frame 20, a leg frame arrangement 30 and a supporting frame 40.

The stationary sear frame 10 is adapted for being sat by a user, and is stationary. The back frame 20 is pivotally connected to the stationary seat frame 10 to move between a sitting mode and a bedding mode. On the other hand, the supporting frame 40 is rearwardly extended from the stationary seat frame 10.

The leg frame arrangement 30 is provided underneath the stationary seat frame 10, the supporting frame 40, and the back frame 20, in such a manner that when the back frame 20 is in the sitting mode, the back frame 20 is pivotally extended from the leg frame arrangement 30 to form a predetermined angle of inclination with respect to the stationary seat frame 10 while the leg frame arrangement 30 is arranged to support the stationary seat frame 10, wherein when the back frame 20 is in the bedding mode, the back frame 20 is pivotally moved to align with the seat frame 10 to form a sleeping area, while the leg frame arrangement 30 is operated to provide extensive support to both the back frame 20, the supporting frame 40, and the stationary seat frame 10.

According to the preferred embodiment of the present invention, the leg frame arrangement 30 comprises a plurality of supporting legs 31 spacedly mounted underneath the seat frame 10 and the supporting frame 40, and an foldable leg frame 32 foldably provided on a rear side of the back frame 20, in such a manner that when the back frame 20 is in the sitting mode, the foldable leg frame 32 is folded to rest on the rear side of the back frame 20. When the back frame 20 is in the bedding mode, the foldable leg frame 32 is extended to from the rear side of the back frame 20 for providing an additional leg support to the back frame 20. As such, the entire multifunctional furniture, including the stationary seat frame 10, the back frame 20 and the supporting frame 40 are adequately supported by the supporting legs 31 and the foldable leg frame 32 when the back frame 20 is in the sitting mode or the bedding mode. This substantially resolves the problems for conventional multifunctional furniture as mentioned above.

The multifunction furniture further comprises a first and a second cushion layer 51, 52 embedding the stationary seat frame 10 and the back frame 20 for allowing a user to seat and rest on the first and the second cushion layer 51, 52. It is worth mentioning that the cushion layers 51, 52 embed the stationary seat frame 10 and the back frame 20 so that the cushion layers 51, 52 and these two frames 10, 20 form an integral body of the multifunctional furniture.

The foldable leg frame 32 comprises a base member 321 mounted on a rear side of the back frame 20, a leg member 322 extended from the base member 321, and a folding mechanism 323 foldably connecting the back frame 20 and the leg member 322 so as to allow the leg member 322 to be selective folded and unfolded to support the back frame 20 to operate in either the sitting mode or the bedding mode.

More specifically, the base member 321 has a base wall 3211 mounted onto the back frame 20, and two sidewalls 3212 extended from the base wall 3211 to form a receiving cavity 3213 between the base wall 3211 and the sidewalls 3212 and a substantially U-shaped cross section of the base member 321. The folding mechanism 323 is operatively mounted in the receiving cavity 3213 for guiding a folding motion of the leg member 322.

The leg member 322 is elongated in shape and has a length which is substantially the same as the supporting legs 31 so that when the back frame 20 is used in the bedding mode, the multifunctional furniture can be evenly supported to stand on a ground surface. On the other hand, the folding mechanism 323 comprises a folding guider 3231 pivotally mounted on the two sidewalls 3212 of the base member 321, wherein an inner end portion of the leg member 322 is mounted to the folding guider 3231 so that when the folding guider 3231 is driven to move pivotally with respect to the base member 321, the leg member 322 is also driven to move accordingly.

The folding guider 3231 has a mounting base 3232 and two side panels 3233 extended from the mounting base 3232 to define a guiding cavity 3234 between the mounting base 3232 and the two side panels 3233, wherein the inner end portion of the leg member 322 is securely mounted on the mounting base 3232. The folding mechanism 32 further comprises a pivot member 33 which is arranged to pass through the curved slot 3235 and extended across the two side panels 3233, wherein the folding guider 3231 is capable of pivotally moving with respect to the base member 321 about the pivot member 33. Thus, one of the side panels 3233 has a through curved slot 3235 formed thereon wherein the folding guider 3231 is pivotally mounted on the base member 321 through this curved slot 3235.

The folding mechanism 323 further comprises a locking device 3236 provided on the folding guider 3231 and the base member 321 for selectively locking the folding action of the folding guider 3231. According to the preferred embodiment of the present invention, the locking device 3236 comprises a resilient member 3237 mounted on the pivot member 33 for normally exerting an outward biasing force on the pivot member 33. Moreover, the locking device 3236 further comprises a locking member 3238 formed on the pivot member 33, wherein the locking member 3238 is cylindrical in structure and is integrally and radially extended from the pivot member 33 to define a pivot section 332 between the locking member 3238 and an enlarged head portion 331 of the pivot member 33. Note that a diameter of the locking member 3238 is substantially the same as that of the enlarged head portion 331 of the pivot member 33 so as to define a contracted pivot section 332 of the pivot member 33. The resilient member 3237 is arranged to normally bias against an inner surface of the locking member 3238 so as to exert an outward force against the pivot member 33. Due to the outward basing force of the resilient member 3237, the pivot section 332 is normally exposed to an exterior of the base member 321.

Figure 4:
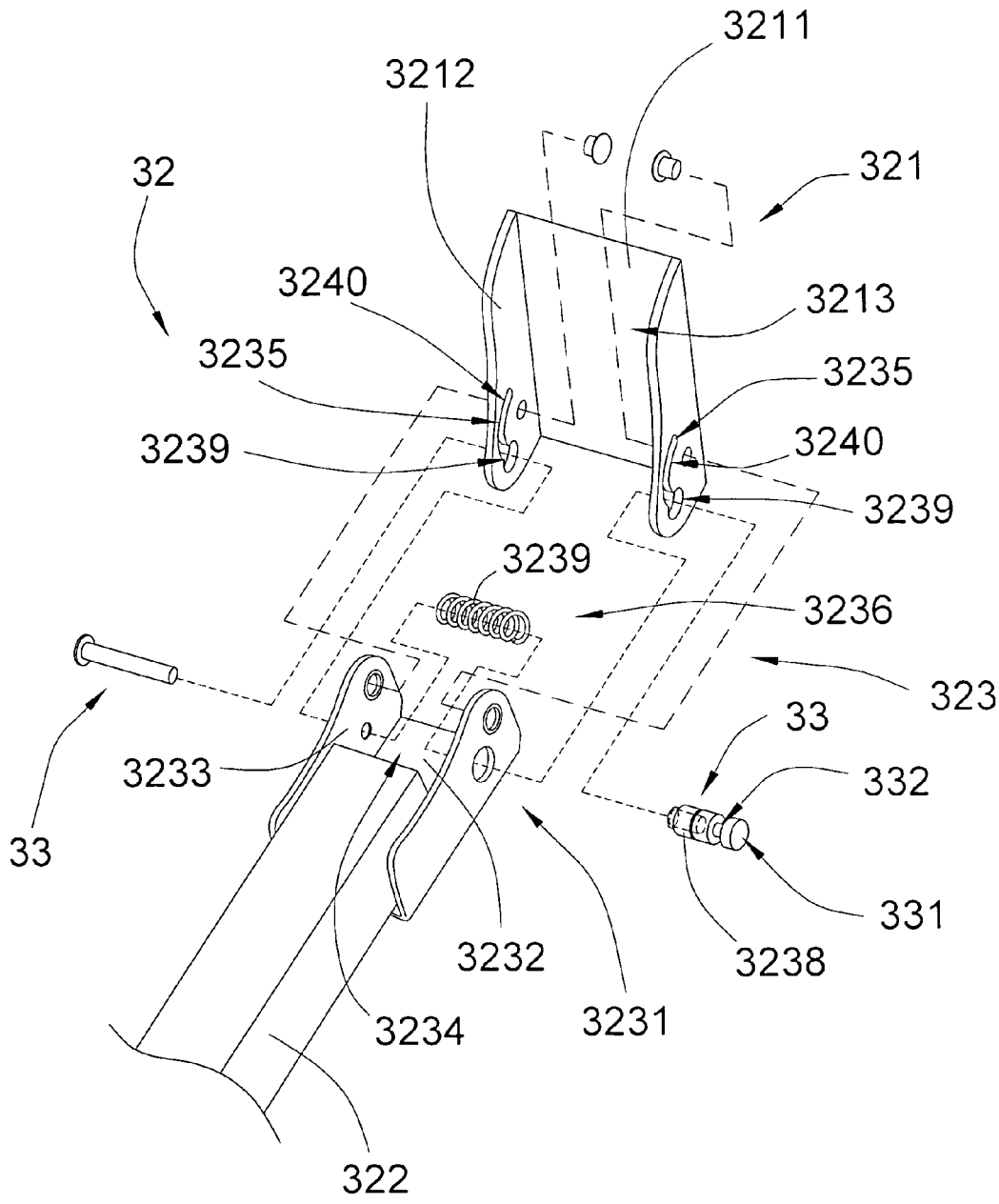
FIG. 4 is a perspective view of the leg arrangement of the multifunctional furniture according to the above preferred embodiment of the present invention.
Figure 5B:
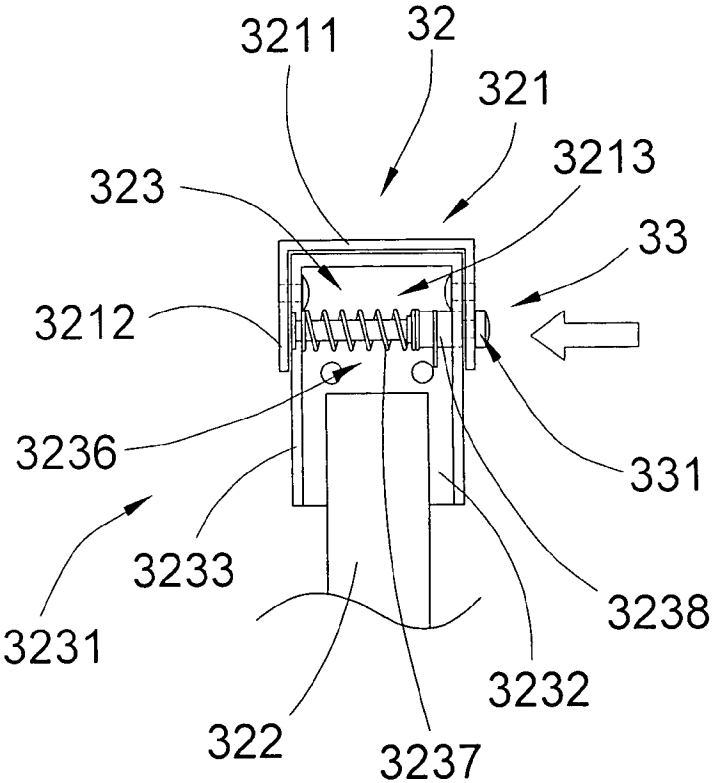
FIG. 5A and FIG. 5B are schematic diagrams of the leg arrangement of the multifunctional furniture according to the above preferred embodiment of the present invention.
Figure 5A:
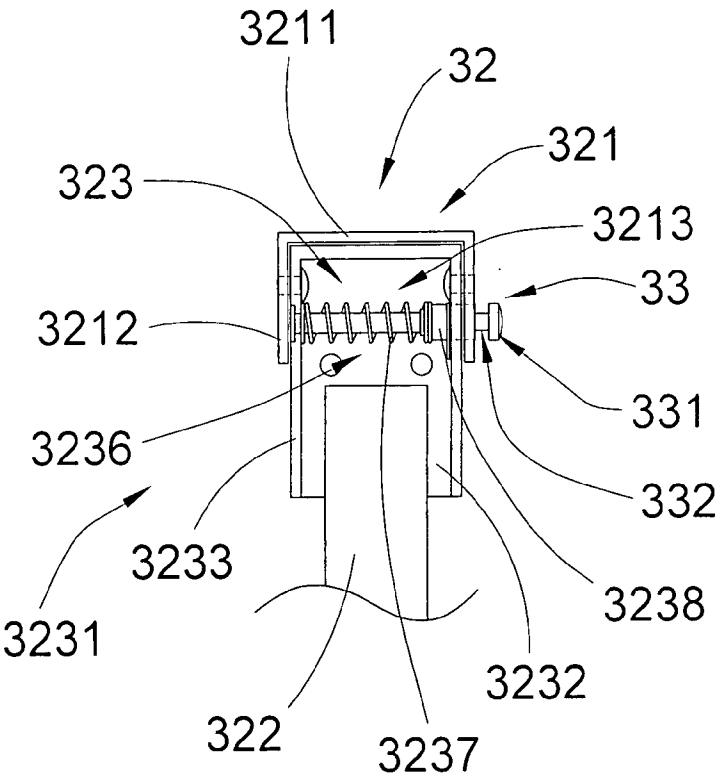
Figure 6A:
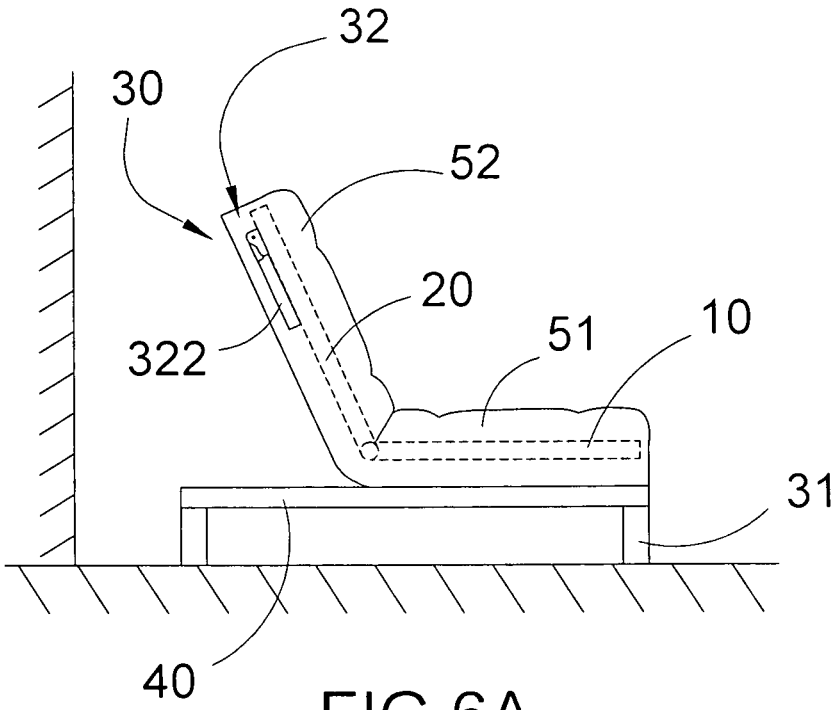
FIG. 6A and FIG. 6B are also schematic diagrams of the multifunctional furniture according to the above preferred embodiment of the present invention.
Figure 6B:
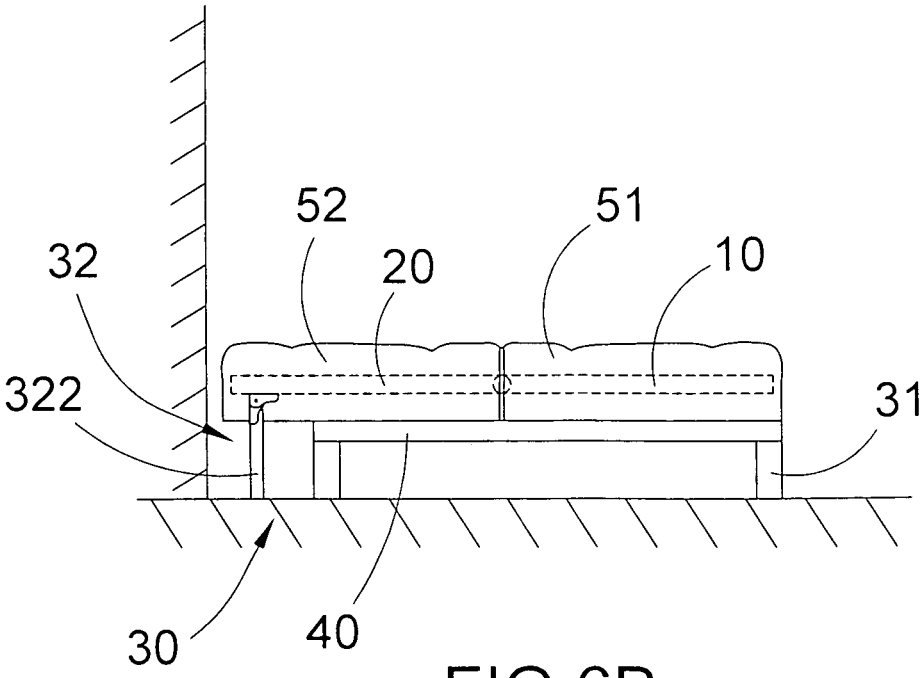

As shown in FIG. 4 of the drawings, it is important to mention that the curved slot 3235 has an enlarged section 3239 and a contracted section 3240, wherein the diameter of the enlarged section 3239 is substantially the same as that of the locking member 3238, while a diameter of the contracted portion 3240 is substantially the same as that of the pivot section 332 of the pivot member 33, wherein the locking member 3238 is normally retained in the enlarged section 3239 of the curved slot 3235 so as to block a pivotal movement between the folding guider 3231 with respect to the base member 321. This happens when the leg member 322 is extended to support the back frame 20. When a user wishes to pivotally move the leg member 322, he or she has to inwardly press the pivot member 33 so as to allow the pivot section 331 to align with the curved slot 3235. After that, the user is able to pivotally move the folding guider 3231 along the curved slot 3235 so as to pivotally fold the leg member 322.

The leg frame arrangement 30 further comprises a receiving pocket 34 formed at a rear side of the second cushion layer 52, wherein the receiving pocket 34 defines a pocket cavity 341 for receiving the foldable leg frame 322, and a pocket opening 342 communicating the pocket cavity 341 with an exterior of the receiving pocket 34. Thus, when the back frame 20 is in the bedding mode, the leg member 322 is selectively unfolded to extend from the back frame 20 through the pocket opening 342. When the back frame 20 is in the sitting mode, the leg member 322 is pivotally folded to receive in the pocket cavity 341. Thus, it is worth mentioning that in order to preserve the aesthetic appearance of the multifunctional furniture, the receiving pocket 34 further comprises a zipper 343 provided at the pocket opening 342 for selectively exposing the pocket cavity 341 with an exterior of the receiving pocket 34. In other words, when the back frame 20 is in the sitting mode, the zipper 343 is operated to close the pocket opening 342 for hiding the foldable leg frame 32.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multifunctional furniture, comprising:

a stationary seat frame;

a supporting frame rearwardly extended from said stationary seat frame;

a back frame pivotally connected to said stationary seat frame to move between a sitting mode and a bedding mode; and a leg frame arrangement which comprises a plurality of supporting legs spacedly mounted underneath said supporting frame and a foldable leg frame foldably provided on a rear side of said back frame, wherein when said back frame is in said sitting mode, said back frame is pivotally extended from said seat frame at a predetermined angle of inclination while said foldable leg frame is folded to rest on said rear side of said back frame, wherein when said back frame is in said bedding mode, said back frame is pivotally moved to align with said seat frame to form a sleeping area and is supported by said supporting frame, wherein at said bedding mode, said foldable leg frame is unfolded to extend from said rear side of said back frame for providing an additional leg support to said back frame, wherein said foldable leg frame comprises a leg member having an elongated shape for standing on a ground surface, a base member mounted at said rear side of said back frame, and a folding mechanism pivotally connecting said back frame and a first end of said leg member to allow a second end of said leg member folding to extend from said rear side of said back frame for standing on the ground surface, wherein said base member comprises a base wall mounted onto said back frame and two sidewalls extended from said base wall to form a U-shaped receiving cavity between said base wall and said sidewalls, wherein said folding mechanism comprises a folding guider coupled at said first end of said leg member and pivotally mounted between said two sidewalls of said base member, so that when said folding guider is driven to move pivotally with respect to said base member, said leg member is also driven to move accordingly to extend from said rear side of said back frame, wherein said folding guider has a mounting base and two side panels extended from said mounting base to define a guiding cavity between said mounting base and said two side panels, wherein said first end of said leg member is securely mounted on said mounting base, wherein said folding mechanism further has two curved slots formed at said sidewalls of said base member respectively and comprises a pivot member which passes through said curved slots and extends across said two side panels, such that when said leg member is pivotally folded, said pivot member is guided to slide at said curved slots so as to guide a folding movement of said leg member, wherein each of said curved slots has an enlarged section and a contracted section, wherein said folding mechanism further comprises a locking device for locking said leg member when said leg member is folded to extend from said rear side of said back frame, wherein said locking device comprises a locking member provided at said pivot member and has a diameter matching with said enlarged section of each of said curved slots, wherein said locking member has a contracted pivot section having a diameter matching with said contracted section of each of said curved slots, wherein when said locking member is located at said enlarged section of said curved slot, said leg member is locked at a position that said leg member is folded to extend from said rear side of said back frame, wherein when said pivot member is pressed inwardly to move said contracted pivot section aligning with said curved slot, said contracted pivot section is guided to slide to said contracted section of said curved slot so as to allow said folding movement of said leg member.

2. The multifunctional furniture, as recited in claim 1, wherein said locking device further comprises a resilient member mounted at said pivot member within said guiding cavity of said folding guider for normally exerting an outward biasing force on said pivot member to ensure said locking member located at said enlarged section of said curved slot.

3. The multifunctional furniture, as recited in claim 2, further comprising a first and a second cushion layer embedding said stationary seat frame and said back frame respectively to form an integral body of said multifunctional furniture.

4. The multifunctional furniture, as recited in claim 3, wherein said leg frame arrangement further comprises a receiving pocket formed at a rear side of said second cushion layer, wherein said receiving pocket defines a pocket cavity for receiving said foldable leg frame, and a pocket opening communicating said pocket cavity with an exterior of said receiving pocket, wherein when said back frame is in said bedding mode, said foldable leg frame is selectively unfolded to extend from said back frame through said pocket opening, wherein when said back frame is in said sitting mode, said foldable leg frame is pivotally folded to receive in said pocket cavity.

* * * * *